US011236952B2

(12) United States Patent
Panic et al.

(10) Patent No.: US 11,236,952 B2
(45) Date of Patent: Feb. 1, 2022

(54) HEAT EXCHANGER

(71) Applicant: Mahle International GmbH, Stuttgart (DE)

(72) Inventors: Predrag Panic, Kirchberg an der Murr (DE); Dieter Schmadl, Marbach (DE)

(73) Assignee: Mahle International GmbH

( * ) Notice: Subject to any disclaimer, the term of this patent is extended or adjusted under 35 U.S.C. 154(b) by 13 days.

(21) Appl. No.: 16/837,974

(22) Filed: Apr. 1, 2020

(65) Prior Publication Data

US 2020/0318916 A1 Oct. 8, 2020

(30) Foreign Application Priority Data

Apr. 2, 2019 (DE) ..... 10 2019 204 640.1

(51) Int. Cl.

| | |
|---|---|
| ***F28F 1/20*** | (2006.01) |
| ***F28F 1/40*** | (2006.01) |
| ***F28D 7/16*** | (2006.01) |
| ***F28F 1/02*** | (2006.01) |
| *F28F 1/04* | (2006.01) |

(52) U.S. Cl.

CPC ..... *F28F 1/40* (2013.01); *F28D 7/16* (2013.01); *F28F 1/02* (2013.01); *F28F 1/04* (2013.01)

(58) Field of Classification Search

CPC ..... F28F 1/40; F28F 1/02; F28F 1/04; F28D 7/16

USPC ..... 165/181

See application file for complete search history.

(56) References Cited

U.S. PATENT DOCUMENTS

| | | | | |
|---|---|---|---|---|
| 6,321,835 | B1 | 11/2001 | Damsohn et al. | |
| 7,942,137 | B2 | 5/2011 | Geskes et al. | |
| 2004/0134640 | A1 | 7/2004 | Sakakibara et al. | |
| 2009/0266104 | A1* | 10/2009 | Ichiyanagi | F28F 9/0209 62/498 |
| 2012/0206755 | A1 | 8/2012 | Nakao | |
| 2015/0060028 | A1* | 3/2015 | Irmler | F28D 7/1638 165/157 |

(Continued)

FOREIGN PATENT DOCUMENTS

| | | | |
|---|---|---|---|
| CN | 104101235 | A | 10/2014 |
| DE | 19654368 | A1 | 6/1998 |

(Continued)

OTHER PUBLICATIONS

English abstract for DE-202019101397.

Chinese Office Action dated Jun. 17, 2021 for copending Chinese Patent Appl. No. CN202010251123.8.

*Primary Examiner* — Davis D Hwu

(74) *Attorney, Agent, or Firm* — Fishman Stewart PLLC

(57) ABSTRACT

A heat exchanger may include an outer casing extending in a longitudinal direction and delimiting a volume through which a first fluid is flowable, and a tube bundle including a plurality of tube bodies arranged in the volume and through which a second fluid is flowable. In a cross section, the volume may have an inner surface area and an inner circumference and each tube body may have an outer circumference and an outer surface area. A ratio of a sum of the outer circumferences to the inner circumference may be at least 5.5, and a sum of the outer surface areas may account for 64% or less of the inner surface area. A residual cross section area of the inner surface area may be delimited between the outer casing and the plurality of tube bodies.

20 Claims, 3 Drawing Sheets

(56) References Cited

U.S. PATENT DOCUMENTS

| | | | | |
|---|---|---|---|---|
| 2016/0169599 | A1* | 6/2016 | Richter | F28F 9/22 165/109.1 |
| 2016/0363380 | A1* | 12/2016 | Siegel | F28D 7/16 |

FOREIGN PATENT DOCUMENTS

| | | | |
|---|---|---|---|
| DE | 102004045923 | A1 | 5/2005 |
| DE | 102005029321 | A1 | 12/2006 |
| DE | 202019101397 | U1 | 4/2019 |

* cited by examiner

HEAT EXCHANGER

CROSS-REFERENCE TO RELATED APPLICATIONS

This application claims priority to German Patent Application No. DE 10 2019 204 640.1, filed on Apr. 2, 2019, the contents of which are hereby incorporated by reference in their entirety.

TECHNICAL FIELD

The present invention relates to a heat exchanger, in particular for exhaust gas, having a volume flowed through by a first fluid, in which a tube bundle is arranged, which is flowed through by a second fluid.

BACKGROUND

Heat exchangers serve for the heat exchange between a first fluid and a second fluid. In certain applications it is desirable to employ a tube bundle in such a heat exchanger. Such heat exchangers, also called tube bundle heat exchangers, thus comprise the tube bundle which comprises multiple tube bodies. The tube bundle is arranged in a volume delimited by an outer casing, wherein the volume is flowed through by a first fluid, whereas the tube bodies are flowed through by a second fluid that is fluidically separated from the first fluid so that during the operation of the heat exchanger, a heat exchange between the fluids occurs.

In order to improve the efficiency of such heat exchangers it is known to provide elements, so-called winglets, which enter the tube bodies. The winglets result in a turbulent flow of the second fluid within the associated tube body so that the heat exchange between the second fluid and the tube body and consequently between the fluids is improved.

For improving the efficiency of such heat exchangers it is known from the prior art, for example from DE 10 2004 045 923 A1 and DE 10 2005 029 321 A1 to optimise the arrangement and/or configuration of the winglets in the respective tube body. The optimisation possibilities of the configuration and arrangement of the winglets are limited because these influence the flow cross sections. When, in addition, they are directly moulded onto the associated tube body, the wall thickness of the tube bodies and material thinning caused during the manufacture of the winglets, likewise form limits of configuration and arrangement of the winglets.

SUMMARY

The present invention therefore deals with the object of stating an improved or at least another embodiment for a heat exchanger of the type mentioned at the outset, which is characterized by an increased efficiency and/or a reduced weight of the heat exchanger.

According to the invention, this object is solved through the subject matter of the independent claim(s). Advantageous embodiments are subject of the dependent claim(s).

The present invention is based on the general idea to adapt, in a heat exchanger having a volume flowed through by a first fluid, in which a tube bundle having multiple tube bodies, which are flowed through by a second fluid, are arranged, the outer lateral surface of the tube bodies to the volume in such a manner that a sum of all outer lateral surfaces, also referred to as outer surfaces, and thus a total outer surface of the tube bodies is enlarged with respect to the volume. The surprising knowledge that a reduction of the dimensions of the respective tube body and a corresponding arrangement of the tube bodies relative to one another result in an enlargement of the total outer surface of the tube bodies is utilised here. This in turn results in an improved heat exchange between the fluids and consequently in an improvement of the efficiency of the heat exchanger. In addition, adapting the tube bodies results in a reduction of the weight of the tube bundle and thus of the heat exchanger.

According to the inventive idea, the heat exchanger comprises an outer casing which extends in a longitudinal direction, a width direction running transversely to the longitudinal direction and a height direction running transversely to the longitudinal direction and transversely to the width direction and delimits the volume flowed through by the first fluid during the operation. Furthermore, the heat exchanger comprises the tube bundle and can therefore be referred to as tube bundle heat exchanger. The tube bundle comprises multiple tube bodies which are arranged in the volume and extend in the longitudinal direction. During the operation, the tube bodies are flowed through by a second fluid, which is fluidically separated from the first fluid, so that during the operation of the heat exchanger a heat exchange between the fluids occurs. Along the longitudinal direction, the heat exchanger thus comprises multiple cross sections which are defined by the width direction and the height direction. In the respective cross section, the volume comprises an inner surface and an inner circumference. In addition, the respective tube body in the respective cross section has an outer surface and an outer circumference. In at least one portion running in the longitudinal direction, which comprises multiple cross sections of the heat exchanger, preferentially along the entire tube bundle, it is true that between the sum of the outer circumferences of the tube bodies and the inner circumference of the volume in the respective associated cross section there is a ratio of at least 5.5 and/or that in the portion each of the inner surfaces of the volume is filled to a maximum of 64% of a total outer surface of all outer surfaces of the tube body. In the respective cross section, the inner surface of the volume is thus filled to a maximum of 64% by the outer surfaces of the tube bodies and/or the outer circumferences of the tube bodies in the cross section is at least 5.5 times greater than the inner circumference of the volume. This is practical in such a manner that the tube bodies delimit the inner surface in a residual cross section flowed through by the first fluid during the operation so that the first fluid can flow through the respective associated cross section, preferentially in the longitudinal direction.

Generally, the heat exchanger can be employed in any application. In particular, the heat exchanger is a heat exchanger for exhaust gas. In particular, the heat exchanger cools exhaust gas, while the heat thus extracted can be employed elsewhere. Thus, the heat exchanger is in particular an exhaust gas heat exchanger.

Here, the first fluid can be a coolant, for example air, and the second fluid can be exhaust gas. The respective fluid preferably flows through the heat exchanger in the longitudinal direction.

Advantageously, the heat exchanger is free of fins and the like, which are attached to the tube bodies on the outside.

The respective tube body has an outer tube body width running in the width direction and an outer tube body height running in the height direction.

In principle, the respective tube body can have any shape and thus have any tube body height and tube body width.

Preferred are embodiments, in which at least one of the tube bodies, preferentially the respective tube body, is formed as a flat tube, in the case of which the tube body width and the tube body height differ from one another. In particular, the tube body width is greater than the tube body height. Thus, the total outer surface of the tube bundle and thus the efficiency of the heat exchanger can be increased.

In preferred embodiments, the tubes of the tube bundle are formed equally, in particular identically. Besides a cost-effective manufacture of the tube bundle, this makes possible a compact design of the tube bundle and an enlargement of the outer surface of the tube bundle.

Analogously, the respective inner surface has a surface height running in the height direction and an inner surface width running in the width direction.

In preferred embodiments, at least one part of the tube bodies, preferentially all tube bodies, have, in the portion, particularly preferably in the respective cross section of the portion, a tube height which corresponds to between 4.80% and 6.90% of the associated surface height. Particularly preferably, the tube height amounts to between 5.00% and 6.70%, further preferably between 5.20% and 6.5%, particularly preferably 5.20% of the associated surface height. Such dimensions of the tube bodies as outer surfaces prove to be enlarging with a reduction of the weight of the tube body at the same time, so that on the one hand the heat-exchanging surface is enlarged and on the other hand the weight reduced.

Here it is preferred when in the respective cross section between ten and twelve tube bodies are arranged one after the other in the height direction. Embodiments, in which in the height direction twelve tube bodies are arranged next to one another prove to be particularly advantageous.

Alternatively or additionally it is provided that at least one part of the tube bodies, preferentially all tube bodies, in the portion, particularly preferably in the respective cross section of the portion, have a tube width which corresponds to between 24.00% and 24.90% of the associated surface width. Preferably, the tube width amounts to between 24.70% and 24.80%, particularly preferably 24.78% of the associated surface width. Such a configuration also results in an increase of the total outer surface of the tube bundle and thus of the heat-exchanging surface while reducing the weight at the same time. Here it is advantageous when in the width direction between three and five, preferably four tube bodies, are arranged next to one another.

Alternatively or additionally it is provided that tube bodies following one another in the width direction each have a width distance from one another running in the width direction, which in the portion with at least one part of the tube bodies, preferentially with all tube bodies, preferably corresponds in the respective cross section to between 2.00% and 3.00% of the associated surface width. This means that at least some of the successive tube bodies, preferentially all tube bodies, have a width distance from one another that corresponds to between 2.00% and 3.00% of the associated surface width. This in turn results in an increase of the heat-exchanging surface of the tube bundle and a reduction of the weight of the tube bundle with simultaneously optimised flow cross section for the first fluid flowing through the volume, so that the efficiency of the heat exchanger is again increased. Particularly preferably, the width distance amounts to between 2.10% and 2.40% of the associated surface width, particularly preferably 2.34% of the associated surface width.

Furthermore, embodiments are preferred, in which the tube bodies each have the same width distance relative to one another, i.e. are arranged equidistantly in the width direction.

It is also conceivable that tube bodies following one another in the height direction each have a height distance relative to one another running in the height direction, which corresponds to between 1.80% and 2.30% of the associated surface width. This means that at least one part of the tube bodies, preferentially all tube bodies, in the portion, particularly preferably in the respective cross section, have a height distance relative to one another which corresponds to between 1.80% and 2.30% of the associated surface width. Thus, the heat-exchanging surface of the tube bundle is again enlarged and the weight of the tube bundle reduced and the cross section that can be flowed through optimised for the first fluid, in particular enlarged. Particularly preferred are embodiments, in which the height distance corresponds to 1.95% and 2.19% of the associated surface height, particularly preferably 2.11% of the surface height. It is preferred, furthermore, when the tube bodies following one another in the height direction each have the same height distance relative to one another, i.e. are arranged equidistantly.

Alternatively or additionally it can be provided that a wall thickness of the respective tube body corresponds to between 0.48% and 0.56% of the associated surface width and/or to between 0.43% and 0.50% of the associate height. In this way, the weight of the tube bundle is reduced and at the same time the cross section that can be flowed through enlarged for the first fluid and/or the arrangement of a larger number of tube bodies and thus the increase of the heat-exchanging of the tube bundle made possible. Thus, the efficiency of the heat exchanger is improved and/or the weight of the heat exchanger reduced.

The tube bodies of the tube bundle are preferentially arranged in rows and/or columns. This means that the tube bundle comprises multiple rows which run in the width direction and are spaced apart from one another in the height direction and/or multiple columns of tube bodies which run in the height direction and are spaced apart from one another in the width direction. This results in an optimisation of the utilisation of the respective available cross section and thus of the volume with increase of the total outer surface of the tube bundle and reduction of the weight of the tube bundle. Here, the respective row, as mentioned, comprises preferentially between three and five, in particular four, tube bodies. The respective column advantageously comprises between nine and eleven, preferably twelve tube bodies.

Generally, the respective tube body can have a flat and/or smooth inner surface and/or outer surface.

Also conceivable are embodiments in which at least one of the tube bodies is formed as a winglet tube body with elements entering the tube body, which thus influence the flow of the second fluid in the tube body. It is conceivable in particular to realise such elements as a moulding of the tube body per se. In this case, the stated dimensions and relationships apply with reference to the tube body prior to the deformation, i.e. to an assumed flat profile of the relevant wall of the tube body.

Alternatively or additionally, the tube body can comprise elements, so-called nubs, projecting to the outside. Such nubs can also be designed as a moulding of the tube body, whereas, as already explained, the particular form of the tube body prior to the deformation applies to the stated conditions and dimensions, i.e. with an assumed flat profile of the relevant wall of the tube.

The nubs of the tube body can be configured as spacer nubs, which space the tube bodies apart relative to one another.

Generally, the volume can have any surface width and/or surface height. In particular, the surface width can amount to between 50.0 mm and 60.0 mm, in particular between 52.0 mm and 56.0 mm, for example 52.7 mm or 55.5 mm. The surface height can amount to between 60.0 mm and 70.0 mm, in particular to between 61.9 mm and 67.0 mm, for example 66.5 mm or 61.5 mm.

When the surface width amounts to 55.5 mm and the surface height 61.5 mm, the tube body width can amount to 13.5 mm, 13.6 mm or 13.75 mm. The tube body height can amount to 3.9 mm, 3.5 mm or 3.22 mm. The width distance of the tube bodies can amount to 1.5 mm, 1.42 mm or 1.3 mm. The height distance of the tube bodies can amount to 1.5 mm, 1.42 mm or 1.3 mm.

A wall thickness of the tube bodies can amount to 0.25 mm and 0.35 mm, in particular to between 0.28 mm and 0.30 mm.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

It shows, in each case schematically

DETAILED DESCRIPTION

Figure 1:
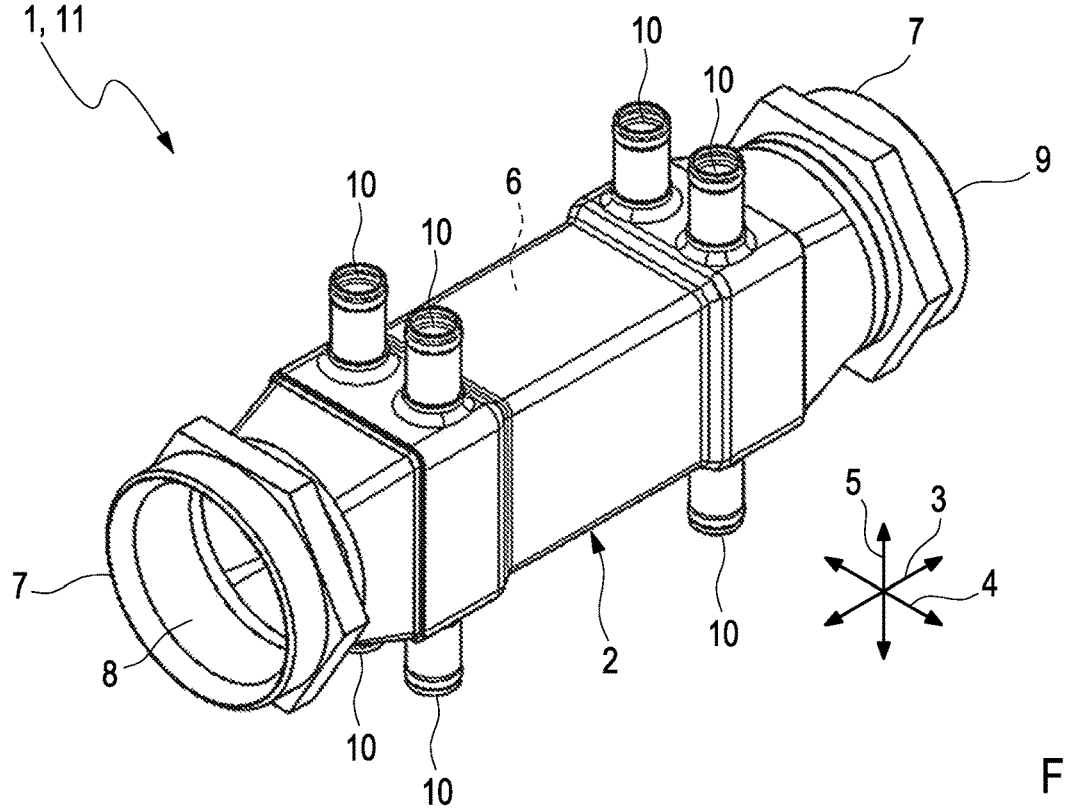
FIG. 1 shows an isometric view of a heat exchanger.

A heat exchanger 1, as shown in FIG. 1, comprises an outer casing 2, which extends in a longitudinal direction 3, a width direction 4 running transversely to the longitudinal direction 3 and a height direction 5 running transversely to the longitudinal direction 3 and transversely to the width direction 4. Here, the outer casing 2 delimits a volume 6 which during the operation of the heat exchanger 1 is flowed through by a first fluid, in particular in the longitudinal direction 3. On longitudinal end sides 7 of the heat exchanger 1 facing away from one another, an inlet opening 8 and an outlet opening 9 are provided in the shown example, through which the first fluid flows during the operation. In addition, a second fluid, separated from the first fluid, additionally flows through the heat exchanger 1 during the operation, which is brought into the volume 6 and out of the volume 6 via corresponding supply openings 10, so that during the operation of the heat exchanger 1 a heat exchange between the first fluid and the second fluid occurs. The first fluid can be exhaust gas while the second fluid is a coolant, so that during the operation of the heat exchanger a cooling of the exhaust gas occurs, so that the heat exchanger 1 is configured as an exhaust gas heat exchanger 11.

Figure 2:
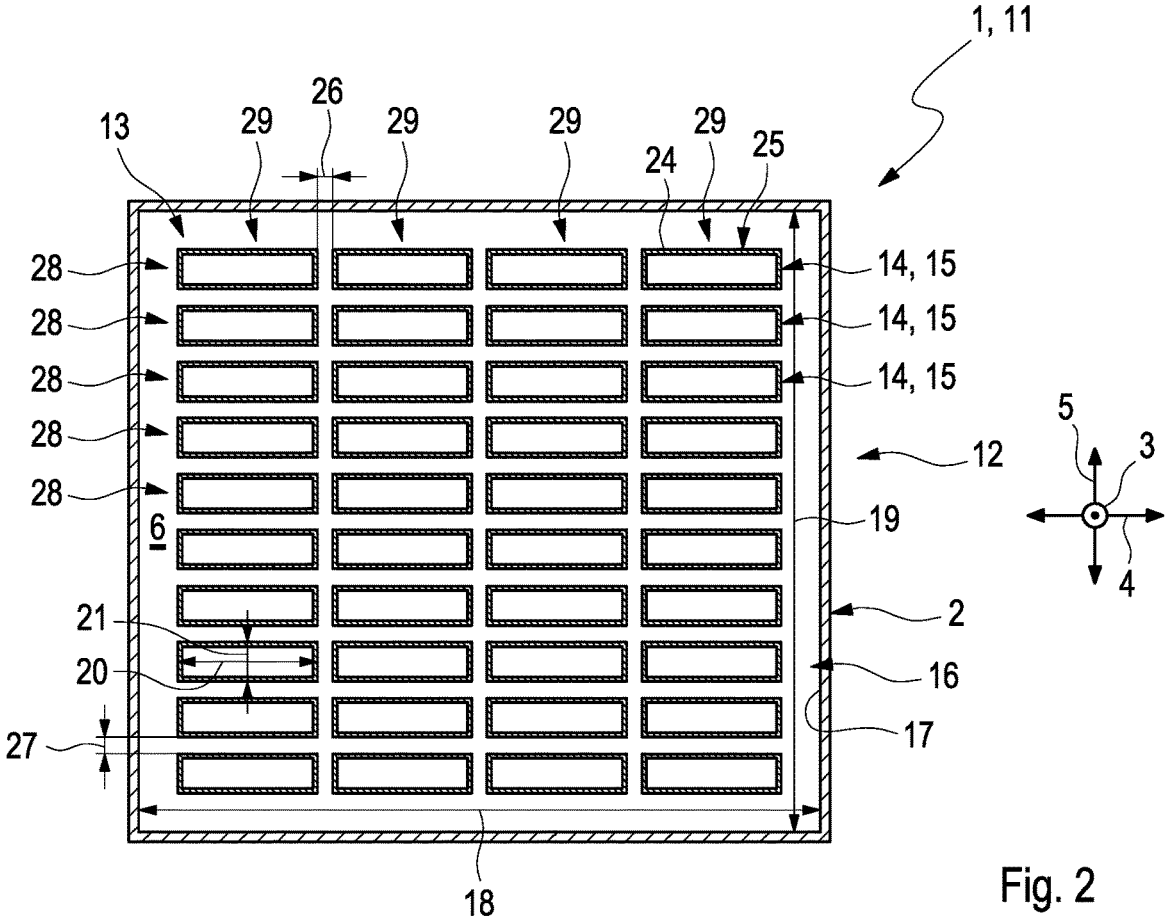
FIG. 2 shows a section through the heat exchanger.
Figure 4:
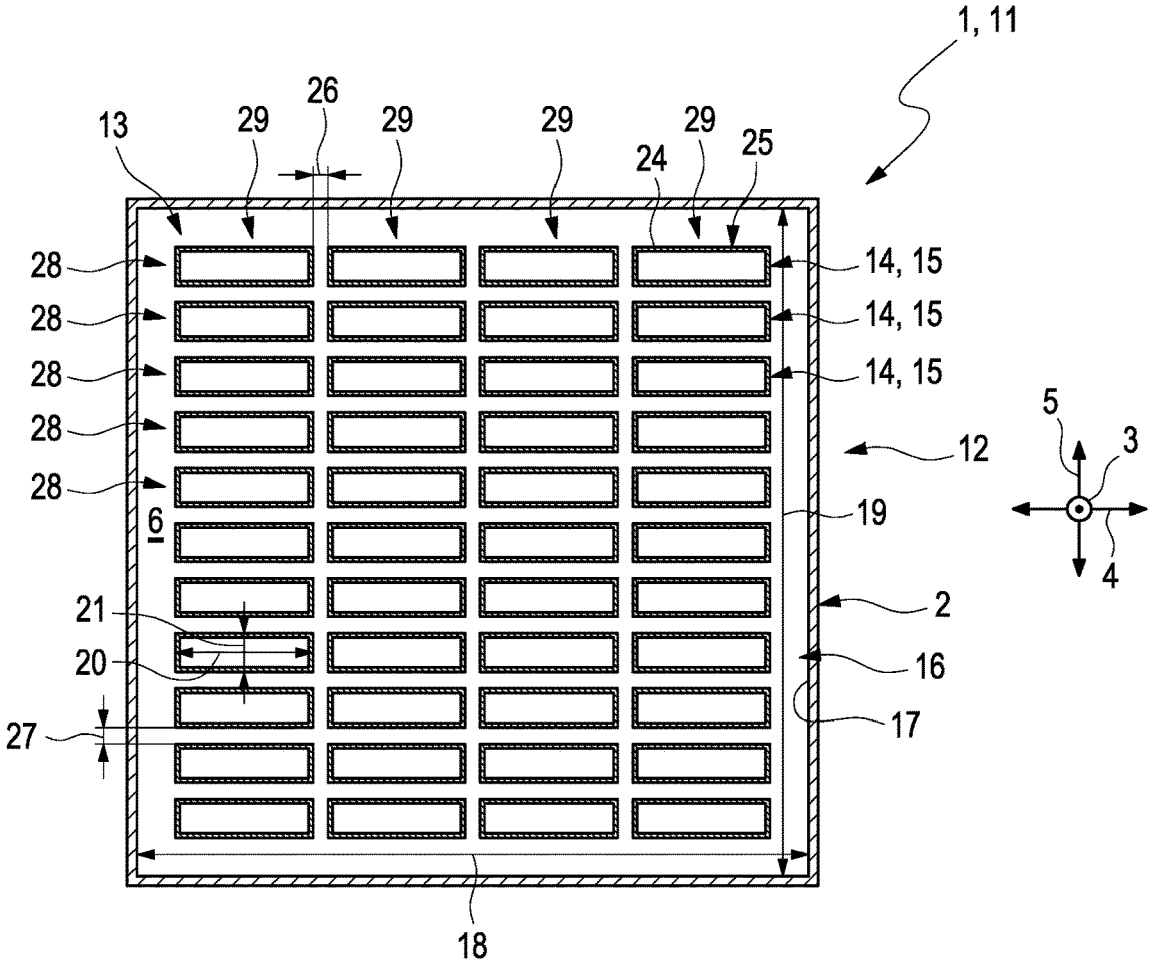
FIG. 4 shows the view from FIG. 2 with another exemplary embodiment.
Figure 5:
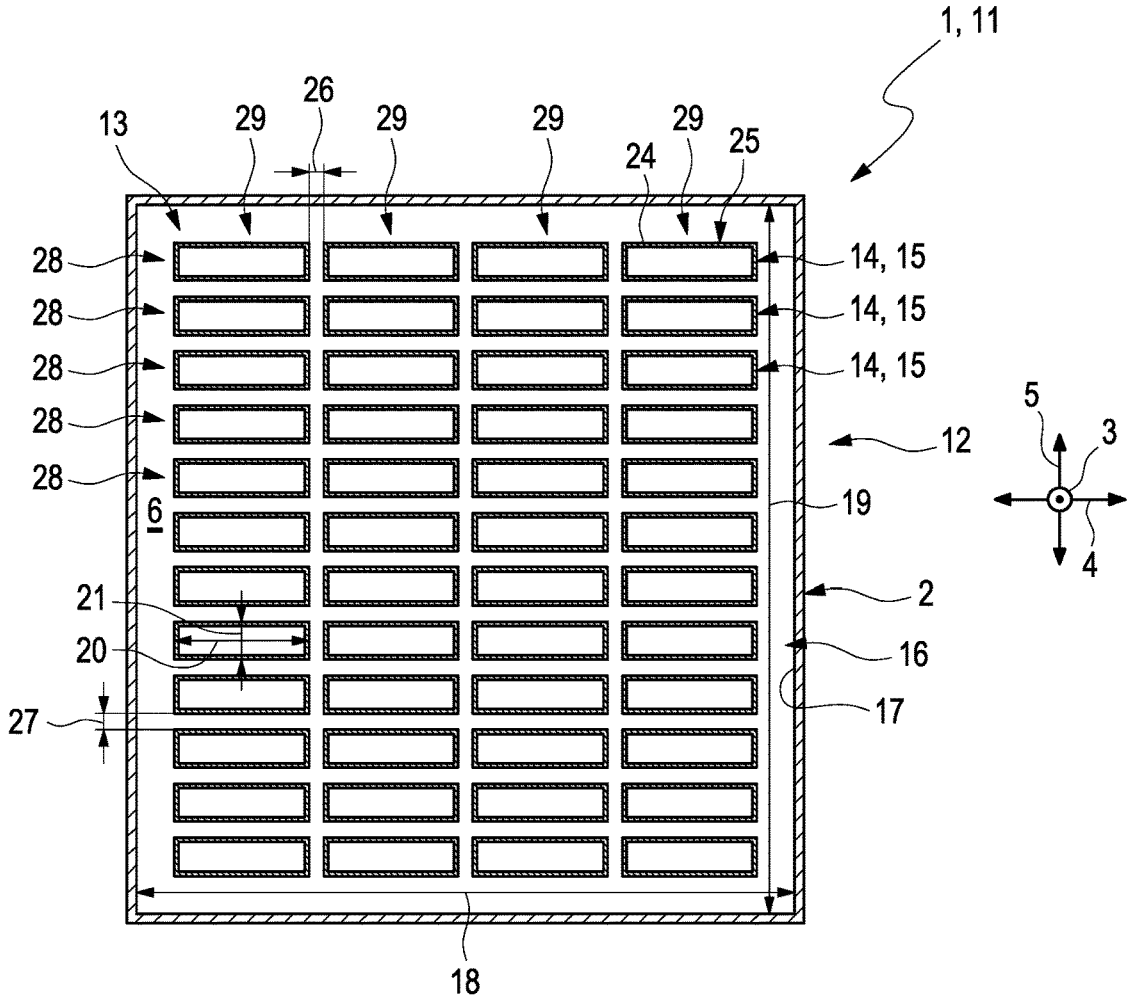
FIG. 5 shows the view from FIG. 2 with a further exemplary embodiment.

The FIGS. 2, 4 and 5 each show a cross section 12 through the outer casing 2 of the heat exchanger 1 with a different exemplary embodiment each, wherein the respective cross section 12 is defined by the width direction 4 and the height direction 5. Accordingly, the heat exchanger 1 comprises a tube bundle 13 with multiple tube bodies 14, which extend through the volume 6 in the longitudinal direction. During the operation, the first fluid, i.e. in particular exhaust gas, flows through the tube body 14 of the tube bundle 13. In the shown examples, the tube bodies 14 are each identical and in each case formed as a flat tube 15. In the respective cross section, the volume 6 has an inner surface 16 delimited by the outer casing 2 and an inner circumference 17 defined by the outer casing 2. In the shown examples, the outer casing 2 and thus the volume 6 is formed rectangular in the cross section 12, so that the inner circumference 17 is formed by twice the sum of a surface width 18 of the inner surface 16 running in the width direction 4 and a surface height 9 of the inner surface 16 running in the height direction 5. In addition, the inner surface 16 corresponds to the product of surface width 18 and surface height 19.

Figure 3:
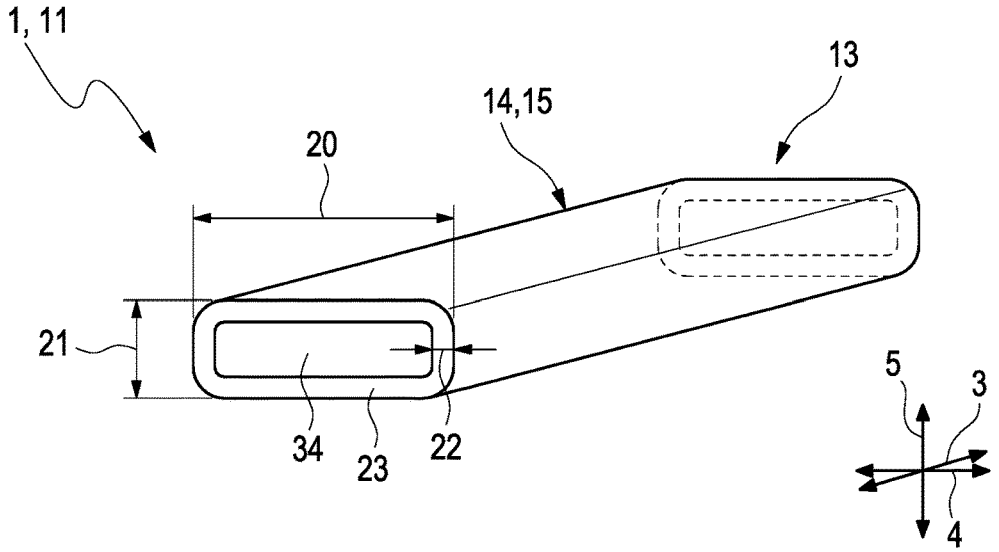
FIG. 3 shows an isometric view of a tube body of the heat exchanger.

In FIG. 3, one of the tube bodies 14 is exemplarily shown. The respective tube body 14 has an outer width 20 running in the width direction 4, also called tube width 20 in the following, and an outer height 21 running in the height direction 5, also called tube height 21 in the following. In addition, the respective tube body 14 has a wall thickness 22 of a wall 23, which delimits a space 34 of the tube body 14 that can be flowed through in the longitudinal direction 3. The tube bodies 14 formed as flat tubes 15 have a tube width 20 in the shown examples, which is greater than the tube height 21. Thus, the respective tube body 14 in the respective cross section 12 has an outer circumference 24 and an outer surface 25, wherein the outer circumference 24 with a rectangular cross section of the respective tube body 14 corresponds to twice the sum of tube width 20 and tube height 21 and the outer surface 25 to the product of tube width 20 and tube height 21.

According to the invention it is provided that in at least one portion of the volume 6 running in the longitudinal direction 3, preferentially along the entire tube bundle 13, the sum of the outer circumferences 24 of all tube bodies in each cross section 12 is at least 5.5 times greater than the associated inner circumference 17 of the volume 6 in the associated cross section 12 and/or that in the said portion in each cross section 12 the inner surface 16 of the volume 6 is maximally filled to 64% of the sum of all outer surfaces 25 of the tube bodies 14 in the associated cross section 12, namely in each case in such a manner that the tube bodies 14 delimit a residual cross section of the inner surface 16 flowed through by the first fluid during the operation. In the sum, the outer surfaces 25 of the tube bodies 14 define a heat-exchanging total outer surface of the tube bundle 13, which in the respective cross section 12 and thus in the said portion is optimised, in particular maximised, wherein an adequate residual cross section of the cross section 12 remains in order to optimise the through-flow of the first fluid and/or in order to reduce the weight of the tube bundle 13 and thus of the heat exchanger 1.

In the shown examples, as mentioned above, the tube bodies 14 are each formed identically and as flat tube 15. In addition, the respective tube bundle 13 comprises tube bodies 14 following one another in the width direction 4 and arranged at a width distance 26 relative to one another, and tube bodies 14 which are arranged next to one another in the height direction 5 having a height distance 27 relative to one another. In the shown examples, the tube bodies 14 following one another in the width direction 4 have a same width distance 26, are thus arranged equidistantly in the width direction 4. Thus, the tube bundle 13 comprises multiple rows 28 running in the width direction 4 and spaced apart in the height direction relative to one another, in particular by the height distance 27, and multiple columns 29 of tube bodies 14 running in the height direction 5 and in the width direction 4, which are in particular spaced apart relative to one another by the width distance 26. In the shown examples, the tube bodies 14 following one another in the height direction 5 have a same height distance 27, are thus arranged equidistantly in the height direction 5.

In the shown examples, the tube height 21 of the respective tube body 14 corresponds to between 4.80% and 6.90% of the surface height 19 in the associated cross section 12. Alternatively or additionally, the tube width 20 of the respective tube body 14 amounts to between 24.00% and 24.90% of the surface width 18 in the associated cross section 12. Alternatively or additionally it can be provided that the width distance 25 of the tube bodies 14 relative to one another corresponds to between 2.00% and 3.00% of the surface width 18 in the associated cross section 12. The height distance 27 of the tube bodies 14 relative to one another can also correspond to between 1.80% and 2.30% of the surface height 19 in the associated cross section 12. It is conceivable, in particular, that the wall thickness 22 of the respective tube body 14 corresponds to between 0.48% and 056% of the surface width 18 and/or to between 0.43% and 0.50% of the associated surface height 19 in the associated cross section 12.

Here, the volume 6 can have any surface width 18 and surface height 19. In particular, the surface width 18 can amount to between 50.00 mm and 60.00 mm, for example 55.5 mm. The surface height 19 can amount to between 55.0 and 65.0 mm, for example 61.5 mm. In the following it is assumed purely exemplarily and for comparative purposes that the surface width 18 amounts to 55.5 mm and the surface height 19 to 61.5 mm. In addition, as explained above, it is assumed for the purpose of an easier comparison that the respective cross section 12 and the respective tube body 14 are formed rectangularly in the cross section 12, even when the respective tube body 14, as visible in FIG. 3, can have rounded corners.

As mentioned, the FIGS. 2, 4 and 5 each show a cross section 12 through the outer casing of the heat exchanger 1 with different exemplary embodiment each. Preferably, the remaining cross sections 12 in the said portion of the respective exemplary embodiment which are not shown are configured corresponding to the shown cross section 12 of the associated exemplary embodiment. In other words, all cross sections 12 in the portion of the respective exemplary embodiment are preferably configured like the shown cross section 12 of the exemplary embodiment.

In the example shown in FIG. 2, four columns 29 and ten rows 28 of the tube bodies 14 and thus forty tube bodies 14 in total are provided. The tube bundle 14 thus comprises forty tube bodies 14, which are each formed identically. The respective tube body 14 has a tube width 20 of 24.32% of the surface width 18, in the assumed example thus a tube width 20 of 13.5 mm. In addition, the respective tube body 14 has a tube height 21, which corresponds to 6.34% of the surface height 19, thus in the assumed example 3.9 mm. Accordingly, the sum of the outer circumferences 24 of the tube bodies 14 is 5.94 times greater than the inner circumference 17 of the volume 6 in the respective cross section 12 of the said portion. In addition to this, the sum of the outer surfaces 25 of the tube bodies 14 amounts to 61.7% of the inner surface 16 of the volume 6. In addition, the width distance 26 of the tube bodies 14 each amounts to 2.70% of the surface width 18, thus in particular 1.5 mm. The height distance 27 of the tube bodies 14 amounts to 2.44% of the surface height 19 or likewise 1.5 mm.

In the example shown in FIG. 4, the tube bundle 13 comprises four rows 28 and eleven columns 29 of the tube bodies 14. Thus, the tube bundle 13 comprises forty-four tube bodies 14 in total. The respective tube body 14 has a tube width 20 which amounts to 24.50% of the surface width 18, thus in the assumed example 13.6 mm. In addition, the respective tube body 14 has a tube height 21 which corresponds to 5.69% of the surface height 19, thus in the assumed example 3.5 mm. Thus, the sum of the outer circumferences 24 of the tube bodies 14 amounts to 6.43 times the inner circumference 17. In addition to this, the inner surface 16 is filled to 61.36% by the sum of the outer surfaces 25 of the tube body 14 and thus by the tube bundle 13. The width distance 26 amounts to 2.56% of the surface width 18, thus in the assumed example 1.42 mm. The height distance 27 corresponds to the width distance 26, thus in the assumed example 1.42 mm or 2.31% of the surface height 19.

In the example shown in FIG. 5, the tube bundle 13 comprises twelve rows 28 and four columns 29 of tube bodies 14 and thus forty-eight tube bodies 14 in total. The tube width 20 of the respective tube body 14 corresponds to 24.77% of the surface width 18, thus in the assumed example to 13.75 mm. The tube height 21 of the respective tube body 14 corresponds to 5.24% of the surface height 19, thus in the assumed example to 3.22 mm. The width distance 26 of the tube body 14 corresponds to 2.34% of the surface width 18, thus in the assumed example to 1.3 mm. The height distance 27 corresponds to the width distance 26 and thus to 2.11% of the surface height 19, in the assumed example thus likewise to 1.3 mm. The sum of the outer circumferences 24 of all tube bodies 14 consequently amounts to 6.96 times the inner circumference 17, while the outer surfaces 25 of all tube bodies 14 and thus of the tube bundle 13 fill the inner surface 16 to 62.26%.

Figure 6:
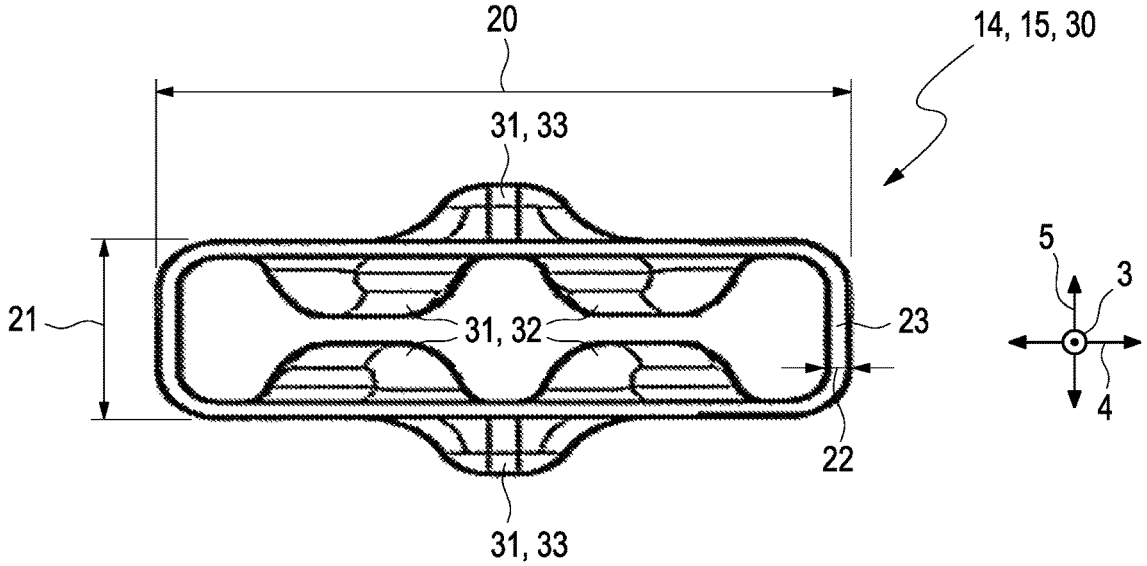
FIG. 6 shows a section through the tube body with another exemplary embodiment.

In FIG. 6, a further exemplary embodiment of a tube body 14, which is likewise formed as a flat tube 15, is shown in section. This tube body 14 is formed as a so-called winglet tube 30 and comprises elements 31, so-called winglets 32, projecting on the inside. In this example, the winglets 32 are moulded towards the inside in the wall 23 of the tube body 14. In addition, the tube body 14 comprises elements 31 projecting to the outside in the form of nubs 33, which in particular can serve the purpose of spacing the neighbouring tube bodies 14 apart relative to one another. The elements 31 projecting to the outside are also formed by a moulding of the wall 23 in the shown example. In FIG. 3 it is illustrated that in such cases the tube width 20 and the tube height 21 relate to the state of the tube body 14 prior to the deformation, so that the elements 31 projecting to the inside and projecting to the outside are not taken into account.

In the respective example, the wall thickness 22 of the tube bodies 14 corresponds to between 0.48% and 0.56% of the surface width 18 or to between 0.43% and 0.05% of the associated surface height 19. In particular, the wall thickness amounts to between 0.28 mm and 0.3 mm.

In all shown examples, an optimisation of the tube bundle 13 as a whole in the available cross section 12, in particular the available volume 6, takes place for increasing the total outer surface of the tube bundle 13 with simultaneous reduction of the weight of the tube bundle 13 and optimisation of the residual cross section. This optimisation increases from the exemplary embodiment 2 shown in FIG. 2 to the exemplary embodiment shown in FIG. 4 and further to the exemplary embodiment shown in FIG. 5.

The invention claimed is:

1. A heat exchanger, comprising:

an outer casing extending in a longitudinal direction and delimiting a volume through which a first fluid is flowable in the longitudinal direction during operation;

a width direction extending transversely to the longitudinal direction;

a height direction extending transversely to the longitudinal direction and transversely to the width direction;

a tube bundle including a plurality of tube bodies through which a second fluid is flowable in the longitudinal direction during operation, the plurality of tube bodies arranged in the volume and extending in the longitudinal direction, the second fluid fluidically separated from the first fluid;

wherein, in a cross section defined by the width direction and the height direction, the volume has an inner surface area and an inner circumference and each tube body of the plurality of tube bodies has an outer circumference and an outer surface area;

wherein, in at least one portion of the volume extending in the longitudinal direction, at least one of:

a ratio of a sum of the outer circumference of each of the plurality of tube bodies to the inner circumference is at least 5.5; and a sum of the outer surface area of each of the plurality of tube bodies accounts for 64% or less of the inner surface area;

wherein a residual cross section area of the inner surface area, through which the first fluid is flowable during operation, is delimited between the outer casing and the plurality of tube bodies.

2. The heat exchanger according to claim 1, wherein the plurality of tube bodies are each structured as a flat tube.

3. The heat exchanger according to claim 1, wherein:

each tube body of at least one subset of the plurality of tube bodies in the at least one portion of the volume have a tube height extending in the height direction; and the tube height corresponds to 4.80% to 6.90% of a surface height of the inner surface area that extends in the height direction.

4. The heat exchanger according to claim 1, wherein:

each tube body of at least one subset of the plurality of tube bodies in the at least one portion of the volume have a tube width extending in the width direction; and the tube width corresponds to 24.00% to 24.90% of a surface width of the inner surface area that extends in the width direction.

5. The heat exchanger according to claim 1, wherein:

each tube body of the plurality of tube bodies is disposed a width distance from each laterally adjacent tube body of the plurality of tube bodies; and in at least one subset of the plurality of tube bodies in the at least one portion of the volume, the width distance corresponds to 2.00% to 3.00% of a surface width of the inner surface area that extends in the width direction.

6. The heat exchanger according to claim 1, wherein:

each tube body of the plurality of tube bodies is disposed a height distance from each vertically adjacent tube body of the plurality of tube bodies; and in at least one subset of the plurality of tube bodies in the at least one portion of the volume, the height distance corresponds to 1.80% to 2.30% of a surface height of the inner surface area that extends in the height direction.

7. The heat exchanger according to claim 1, wherein each tube body of at least one subset of the plurality of tube bodies in the at least one portion of the volume have a wall thickness that corresponds to 0.48% to 0.56% of a surface width of the inner surface area that extends in the width direction.

8. The heat exchanger according to claim 1, wherein the tube bundle includes a plurality of rows of the plurality of tube bodies, the plurality of rows extending in the width direction and disposed spaced apart from one another in the height direction.

9. The heat exchanger according to claim 8, wherein each row of the plurality of rows includes 3 to 5 tube bodies of the plurality of tube bodies.

10. The heat exchanger according to claim 1, wherein at least one tube body of the plurality of tube bodies is structured as a winglet tube body including a plurality of elements protruding into the at least one tube body.

11. The heat exchanger according to claim 1, wherein each tube body of at least one subset of the plurality of tube bodies in the at least one portion of the volume have a wall thickness that corresponds to 0.43% to 0.50% of a surface height of the inner surface area that extends in the height direction.

12. The heat exchanger according to claim 1, wherein the tube bundle includes a plurality of columns of the plurality of tube bodies, the plurality of columns extending in the height direction and disposed spaced apart from one another in the width direction.

13. The heat exchanger according to claim 12, wherein each column of the plurality of columns includes 9 to 14 tube bodies of the plurality of tube bodies.

14. A heat exchanger, comprising:

an outer casing extending in a longitudinal direction and delimiting a volume through which a first fluid is flowable in the longitudinal direction during operation;

a width direction extending transversely to the longitudinal direction;

a height direction extending transversely to the longitudinal direction and transversely to the width direction;

a tube bundle including a plurality of tube bodies through which a second fluid is flowable in the longitudinal direction during operation, the plurality of tube bodies arranged in a plurality of rows and a plurality of columns within the volume and extending in the longitudinal direction, the second fluid fluidically separated from the first fluid;

wherein, in a cross section defined by the width direction and the height direction, the volume has an inner circumference surrounding an inner surface area and each tube body of the plurality of tube bodies has an outer circumference surrounding an outer surface area;

wherein, at least one of:

a ratio of a sum of the outer circumference of each of the plurality of tube bodies to the inner circumference is at least 5.5; and a sum of the outer surface area of each of the plurality of tube bodies accounts for 64% or less of the inner surface area;

wherein a residual cross section area of the inner surface area, through which the first fluid is flowable during operation, is delimited between the outer casing and the plurality of tube bodies.

15. The heat exchanger according to claim 14, wherein:

the plurality of tubes bodies of each row of the plurality of rows are disposed a width distance from one another; and the width distance corresponds to 2.00% to 3.00% of a surface width of the inner surface area that extends in the width direction.

16. The heat exchanger according to claim 14, wherein:

the plurality of tubes bodies of each column of the plurality of columns are disposed a height distance from one another; and the height distance corresponds to 1.80% to 2.30% of a surface height of the inner surface area that extends in the height direction.

17. A heat exchanger, comprising:

a longitudinal direction, a width direction extending transversely to the longitudinal direction, and a height direction extending transversely to the longitudinal direction and transversely to the width direction;

an outer casing extending in the longitudinal direction and delimiting a volume through which a first fluid is flowable during operation;

a tube bundle including a plurality of flat tube bodies through which a second fluid is flowable during operation, the plurality of tube bodies arranged within the volume and extending in the longitudinal direction;

wherein, in a cross section defined by the width direction and the height direction, the volume has an inner circumference surrounding an inner surface area and each tube body of the plurality of tube bodies has an outer circumference surrounding an outer surface area;

wherein a ratio of a sum of the outer circumference of each of the plurality of tube bodies to the inner circumference is at least 5.5; and wherein a residual cross section area of the inner surface area is delimited between the outer casing and the plurality of tube bodies, the residual cross section area defining a through flow area of the first fluid during operation.

18. The heat exchanger according to claim 17, wherein a sum of the outer surface area of each of the plurality of tube bodies accounts for 64% or less of the inner surface area.

19. The heat exchanger according to claim 17, wherein:

each tube body of the plurality of tube bodies have a tube height extending in the height direction; and the tube height corresponds to 4.80% to 6.90% of a surface height of the inner surface area that extends in the height direction.

20. The heat exchanger according to claim 17, wherein:

each tube body of the plurality of tube bodies have a tube width extending in the width direction; and the tube width corresponds to 24.00% to 24.90% of a surface width of the inner surface area that extends in the width direction.

* * * * *